US010747148B1

(12) United States Patent
Oka et al.

(10) Patent No.: US 10,747,148 B1
(45) Date of Patent: Aug. 18, 2020

(54) IMAGE FORMING APPARATUS AND RECORDING MATERIAL GUIDE DEVICE

(71) Applicant: FUJI XEROX CO., LTD., Tokyo (JP)

(72) Inventors: Hiroki Oka, Kanagawa (JP); Akira Shimodaira, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/514,397

(22) Filed: Jul. 17, 2019

(30) Foreign Application Priority Data

Mar. 11, 2019 (JP) ..... 2019-044238

(51) Int. Cl.
*G03G 15/16* (2006.01)
*G03G 15/00* (2006.01)

(52) U.S. Cl.
CPC ..... *G03G 15/165* (2013.01); *G03G 15/657* (2013.01); *G03G 15/6535* (2013.01); *G03G 15/6558* (2013.01)

(58) Field of Classification Search
CPC ..... G03G 15/165; G03G 15/6535; G03G 15/6558; G03G 15/657
See application file for complete search history.

(56) References Cited

U.S. PATENT DOCUMENTS 5,697,030 A * 12/1997 Hayashi ..... G03G 15/165 399/299
7,664,445 B2 2/2010 Nishida et al.
2003/0039488 A1* 2/2003 Fayette ..... G03G 15/165 399/316
2007/0297829 A1* 12/2007 Kurosu ..... G03G 15/6558 399/121
2010/0061777 A1* 3/2010 Matsumoto ..... G03G 15/161 399/316
2016/0170363 A1* 6/2016 Kogure ..... G03G 15/6558 399/316
2016/0170364 A1* 6/2016 Kogure ..... G03G 15/161 399/316
2016/0370738 A1* 12/2016 Suzuki ..... G03G 15/1605

FOREIGN PATENT DOCUMENTS

JP 2007-304430 A 11/2007
JP 2008-058593 A 3/2008
JP 2010-089925 A 4/2010

* cited by examiner

*Primary Examiner* — Ryan D Walsh
(74) *Attorney, Agent, or Firm* — Sughrue Mion, PLLC

(57) ABSTRACT

An image forming apparatus includes a transfer section, a guide section, and a plate material. The transfer section transfers an image to a recording material. The guide section guides the recording material toward the transfer section. The plate material is provided on the guide section, and is more easily elastically deformable than the guide section. The plate material guides the recording material, which is transported to the plate material, along a plate surface of the plate material. The plate material is thinner on a downstream side in a transport direction than on an upstream side.

14 Claims, 7 Drawing Sheets

IMAGE FORMING APPARATUS AND RECORDING MATERIAL GUIDE DEVICE

CROSS-REFERENCE TO RELATED APPLICATIONS

This application is based on and claims priority under 35 USC 119 from Japanese Patent Application No. 2019-044238 filed Mar. 11, 2019.

BACKGROUND

(i) Technical Field

The present disclosure relates to an image forming apparatus and a recording material guide device.

(ii) Related Art

Japanese Unexamined Patent Application Publication No. 2010-89925 discloses an image forming apparatus that includes an image carrier, on a surface of which a toner image may be carried, a transfer device that is capable of transferring the toner image on the image carrier to a transfer material, and a transfer material guide member that guides the transfer material toward a transfer position in the transfer device, in which the transfer material guide member has a guide leading end portion inclined along the width direction, which forms a right angle with respect to the moving direction of the transfer material, to make the timing to release the transfer material different between one end side and the other end side in the width direction.

SUMMARY

A guide section that guides a recording material to a transfer section that transfers an image to the recording material and that is provided with a plate material that is more easily elastically deformable than the guide section, for example, is known. The plate material guides the recording material to the transfer section etc. together with the guide section.

The quality of the image to be formed on the recording material may be lowered depending on the angle at which the leading end of the recording material guided by the plate material is directed to the transfer section, for example. Therefore, there is a demand to support the leading end side of the recording material relatively strongly. If the rear end of the recording material is supported strongly, on the other hand, the quality of the image may be lowered since the recording material is bounced when the recording material passes through the plate material, for example. Therefore, there is also a demand to support the rear end side of the recording material relatively weakly.

Aspects of non-limiting embodiments of the present disclosure relate to suppressing a reduction in the quality of an image to be formed on a recording material compared to a case where the thickness of a plate material is not varied in the transport direction of the recording material.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including: a transfer section that transfers an image to a recording material; a guide section that guides the recording material toward the transfer section; and a plate material that is provided on the guide section and that is more easily elastically deformable than the guide section, the plate material guiding the recording material, which is transported to the plate material, along a plate surface of the plate material, and being thinner on a downstream side in a transport direction than on an upstream side.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will be described below with reference to the accompanying drawings.

<Image Forming Apparatus 1>

Figure 1:
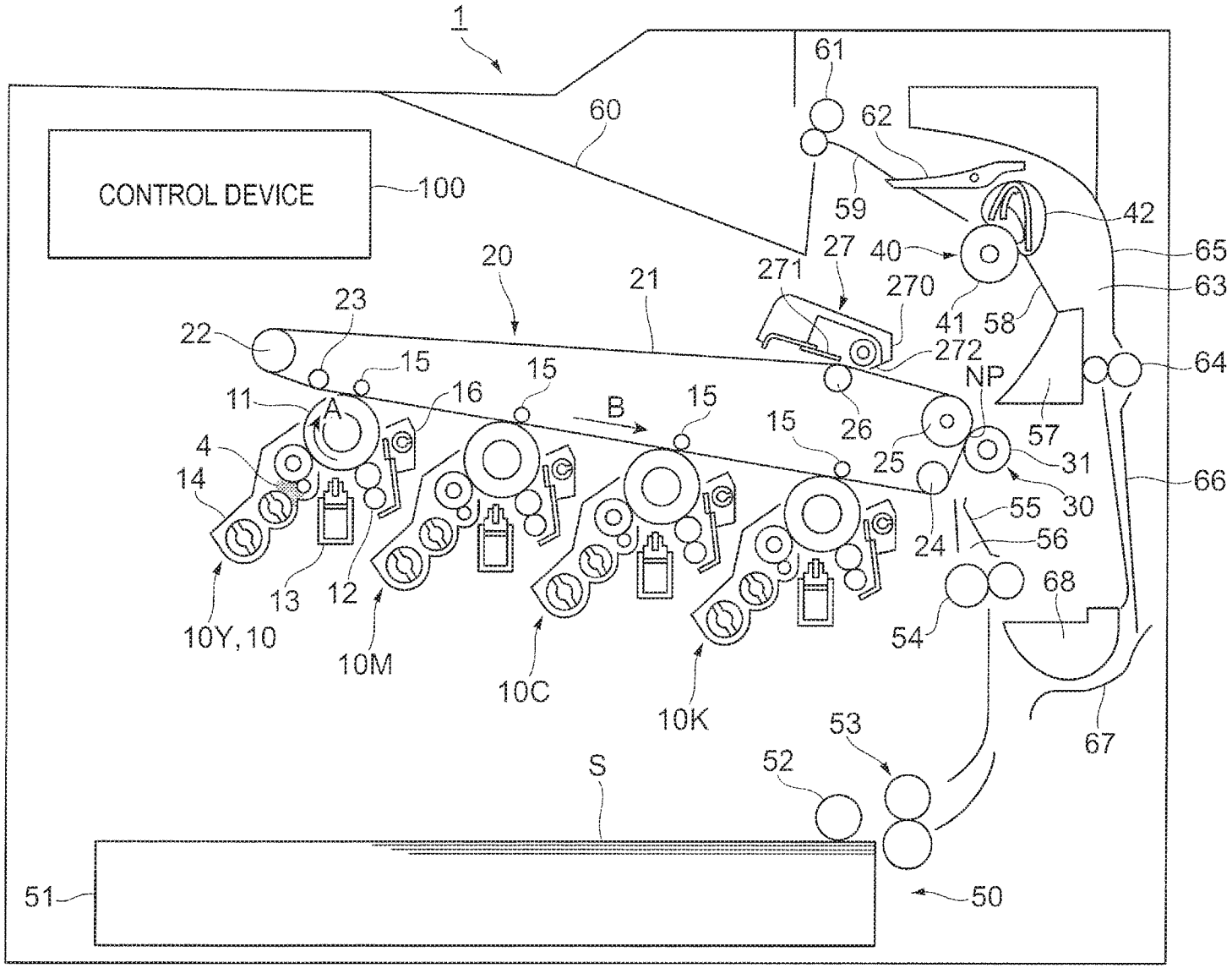
FIG. 1 illustrates the overall configuration of an image forming apparatus according to the present exemplary embodiment.

FIG. 1 illustrates the overall configuration of an image forming apparatus 1 according to the present embodiment.

The image forming apparatus 1 is constituted as a color printer, for example. The image forming apparatus 1 includes a plurality of image preparing devices 10, an intermediate transfer device 20, a paper feed device 50, a fixing device 40, etc. The image preparing devices 10 form a toner image. The intermediate transfer device 20 holds toner images formed by the image preparing devices 10, and transports the toner images to a second transfer position (nip point NP) at which the toner images are transferred to paper S, which is an example of a recording material, through a second transfer. The paper feed device 50 supplies the paper S to the intermediate transfer device 20. The fixing device 40 fixes the toner images on the paper S which have been transferred thereto through the second transfer by the intermediate transfer device 20.

The image preparing devices 10 are composed of four image preparing devices 10Y, 10M, 10C, and 10K that form toner images in four colors, namely yellow (Y), magenta (M), cyan (C), and black (K), respectively. The image preparing devices 10 (Y, M, C, K) are disposed side by side in line in an inclined state.

The image preparing devices 10 (Y, M, C, K) each include a photosensitive drum 11. The following devices are disposed around the photosensitive drum 11. That is, the devices include a charging device 12, an exposure device 13, a developing device 14, a first transfer device 15, a cleaning device 16, etc. The charging device 12 charges the photosensitive drum 11. The exposure device 13 radiates light to the peripheral surface of the photosensitive drum 11, which has been charged, to form an electrostatic latent image. The developing device 14 develops the electrostatic latent image using a developer 4 in the corresponding color. The first transfer device 15 transfers the toner image to the intermediate transfer device 20. The cleaning device 16 cleans the photosensitive drum 11 by removing attached matter attached to the photosensitive drum 11 after the first transfer.

The photosensitive drum 11 has an image holding surface formed by providing a photoconductive layer made of a photosensitive material on the peripheral surface of a grounded cylindrical base material. The photosensitive drum 11 is driven by a drive device (not illustrated) to be rotated in the direction indicated by the arrow A.

The charging device 12 is constituted as a charging roller disposed in contact with the photosensitive drum 11. A charging voltage is supplied to the charging device 12.

The exposure device 13 radiates light to the photosensitive drum 11 in accordance with information on an image input to the image forming apparatus 1 to form an electrostatic latent image on the photosensitive drum 11. The exposure device 13 includes light emitting diodes (LEDs) arranged along the axial direction of the photosensitive drum 11.

The developing device 14 develops the electrostatic latent image formed on the photosensitive drum 11 using a toner in the corresponding color. The developing device 14 contains therein the developer 4 which contains a toner in a color determined in advance. The developing device 14 uses, as the developer 4, a so-called two-component developer that contains a carrier having magnetic properties and a toner colored in a color determined in advance. A so-called one-component developer that contains only a toner may also be used as the developer 4.

The first transfer device 15 is a contact transfer device that includes a first transfer roller that is rotatable in contact with the periphery of the photosensitive drum 11 via an intermediate transfer belt 21 and that is supplied with a first transfer voltage. A DC voltage having a polarity opposite to the polarity for charging the toner is supplied from a power source device (not illustrated) as the first transfer voltage.

The cleaning device 16 has a blade member disposed in contact with the photosensitive drum 11, for example, and removes attached matter such as a toner on the photosensitive drum 11 after the transfer and before being charged.

The intermediate transfer device 20 is positioned above the image preparing devices 10 (Y, M, C, K). The intermediate transfer device 20 includes the intermediate transfer belt 21, a plurality of belt support rollers 22 to 26, a second transfer device 30, and a belt cleaning device 27. The intermediate transfer belt 21 is rotatable in the direction indicated by the arrow B while passing through first transfer positions between the photosensitive drums 11 and the first transfer devices 15. The belt support rollers 22 to 26 rotatably support the intermediate transfer belt 21 from the inner side. The second transfer device 30 is disposed on the side of the outer peripheral surface of the intermediate transfer belt 21 which is supported by the belt support roller 25 to transfer the toner image on the intermediate transfer belt 21 to the paper S through a second transfer. The belt cleaning device 27 cleans the intermediate transfer belt 21 by removing a toner etc. remaining on and attached to the outer peripheral surface of the intermediate transfer belt 21 after passing through the second transfer device 30.

The intermediate transfer belt 21 is an endless belt formed from a polyimide resin etc., for example. The belt support roller 25 is constituted as a back-up roller that constitutes a second transfer unit and a drive roller rotationally driven by a drive device (not illustrated). The belt support roller 22 is constituted as a tension applying roller that applies tension to the intermediate transfer belt 21 and a belt meandering correction roller that corrects meandering of the intermediate transfer belt 21. The belt support rollers 23 and 24 are each constituted as a driven roller that holds the travel position etc. of the intermediate transfer belt 21. The belt support roller 26 is constituted as a support roller that supports the back surface of the intermediate transfer belt 21 which is cleaned by the belt cleaning device 27.

The second transfer device 30 includes a second transfer roller 31 that constitutes the second transfer unit which is provided at the nip point NP, which is a portion of the outer peripheral surface of the intermediate transfer belt 21 supported by the belt support roller 25 in the intermediate transfer device 20. The second transfer roller 31 is rotatable in contact with the peripheral surface of the intermediate transfer belt 21, and is supplied with a second transfer voltage.

The belt cleaning device 27 includes a body 270 and a cleaning plate 271 disposed in contact with the peripheral surface of the intermediate transfer belt 21 after the second transfer to clean the intermediate transfer belt 21 by removing attached matter.

The fixing device 40 includes a heating rotary member 41, a pressurizing rotary member 42, etc. The heating rotary member 41 is in the form of a drum or a belt, and is heated by a heating unit. The pressurizing rotary member 42 is in the form of a drum or a belt, and is rotatable along the axial direction of the heating rotary member 41. In the fixing device 40, a contact portion at which the heating rotary member 41 and the pressurizing rotary member 42 contact each other applies heat and pressure.

The paper feed device 50 is disposed below the image preparing devices 10 (Y, M, C, K). The paper feed device 50 includes a paper storing member 51 that stores the paper S loaded therein and feed devices 52 and 53 that feed the paper S from the paper storing member 51, one sheet at a time.

Examples of the paper S include regular paper which is used for copiers, printers, etc. and thin paper such as OHP sheets and tracing paper. In order to further improve the smoothness of an image surface after the fixation, the surface of the paper S is preferably as smooth as possible. Other examples of the paper S include coated paper, which is formed by coating a surface of regular paper with a resin etc., and so-called cardboard with a relatively heavy basis weight such as art paper for printing.

A paper feed/transport path 56 is provided between the paper feed device 50 and the second transfer device 30. The paper feed/transport path 56 includes a pair of paper transport rollers 54, a transport guide 55, etc. The pair of paper transport rollers 54 transport the paper S, which is fed from the paper feed device 50, to the nip point NP. The pair of paper transport rollers 54 are constituted as rollers (registration rollers) that adjust the timing to transport the paper S, for example.

Transport guides 57 and 58 are provided between the second transfer device 30 and the fixing device 40. The transport guides 57 and 58 transport the paper S which is fed from the second transfer device 30. Further, a pair of paper ejection rollers 61 are disposed. The pair of paper ejection rollers 61 eject the paper S, which is fed from the fixing device 40, to a paper ejection portion 60 provided along a transport guide 59.

A switching gate 62 is provided between the fixing device 40 and the pair of paper ejection rollers 61. The switching gate 62 switches the paper transport path. The rotational direction of the pair of paper ejection rollers 61 is reversible. In the case where an image is to be formed on both surfaces of the paper S, the paper S is transported to a two-sided printing transport path 63 by the pair of paper ejection rollers 61 which are rotated in reverse. The two-sided printing transport path 63 includes a pair of paper transport rollers 64, transport guides 65 to 68, etc. The pair of paper transport rollers 64 transport the paper S to the pair of paper transport rollers 54 with the front and back sides of the paper S reversed.

The image forming apparatus 1 is provided with a control device 100 that comprehensively controls operation of the image forming apparatus 1. The control device 100 includes a central processing unit (CPU), a read only memory (ROM), a random access memory (RAM), a bus that connects between the CPU, the ROM, etc., a communication interface, etc. (not illustrated).

<Operation of Image Forming Apparatus 1>

Image forming operation performed by the image forming apparatus 1 will be described below.

When the image forming apparatus 1 receives an image forming instruction, the image preparing devices 10 (Y, M, C, K), the intermediate transfer device 20, the second transfer device 30, the fixing device 40, etc. are started.

Specifically, in each of the image preparing devices 10 (Y, M, C, K), the photosensitive drum 11 is rotated, and the charging device 12 charges the surface of the photosensitive drum 11. The exposure device 13 radiates light to the photosensitive drum 11 to form an electrostatic latent image, and the image preparing device 10 (Y, M, C, K) develops the electrostatic latent image. When a toner image on the photosensitive drum 11 is transported to the first transfer position, the first transfer device 15 transfers the toner image to the intermediate transfer belt 21 through a first transfer.

The intermediate transfer device 20 transports the toner images, which have been transferred through the first transfer, to the nip point NP through rotation of the intermediate transfer belt 21. On the other hand, the paper feed device 50 feeds the paper S, and the pair of paper transport rollers 54 feeds the paper S to the nip point NP in accordance with the transfer timing.

At the nip point NP, the second transfer roller 31 of the second transfer device 30 collectively transfers the toner images on the intermediate transfer belt 21 to the paper S through a second transfer. Subsequently, the paper S, to which the toner images have been transferred through a second transfer, is transported to the fixing device 40. The fixing device 40 fixes the toner images to the paper S. The paper S after the fixation is ejected to the paper ejection portion 60. As a result of the operation described above, the paper S is output with a full-color image formed thereon by combining the toner images in the four colors.

When an image is to be formed on both surfaces of the paper S, the pair of paper ejection rollers 61 are rotated in reverse while the pair of paper ejection rollers 61 are holding the rear end of the paper S. The paper S is transported to the pair of paper transport rollers 54, with the front and back sides of the paper S reversed, via the two-sided printing transport path 63. The paper S is supplied to the nip point NP again by the pair of paper transport rollers 54, and ejected to the paper ejection portion 60 after an image is formed on the back surface of the paper S.

<Transport Guide 55>

Figure 2:
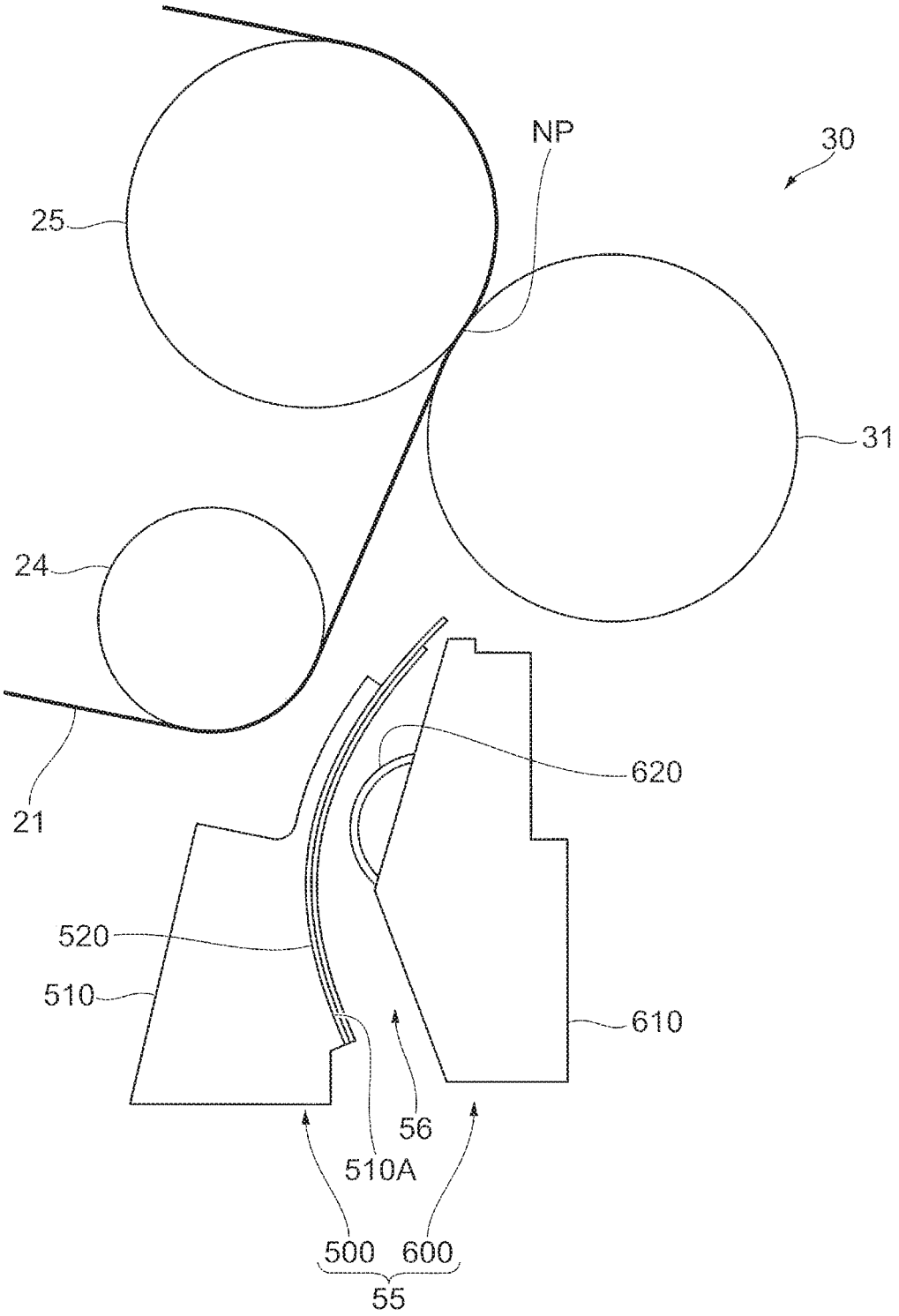
FIG. 2 illustrates components around a transport guide according to the present exemplary embodiment.

FIG. 2 illustrates components around the transport guide 55 according to the present exemplary embodiment.

Next, a schematic configuration of the components around the transport guide 55 will be described with reference to FIGS. 1 and 2.

As illustrated in FIG. 2, the transport guide 55 is provided below the second transfer device 30. The transport guide 55 includes a principal guide device 500 and an auxiliary guide device 600. The principal guide device 500 and the auxiliary guide device 600 are disposed at positions facing each other with the paper feed/transport path 56 interposed therebetween. The principal guide device 500 includes a chute 510 that guides the paper S and a mylar 520 which is a member in the shape of a thin plate or a sheet provided on the chute 510 (to be discussed in detail later). The auxiliary guide device 600 includes a chute 610 that guides the paper S and a guide roller 620 provided on the chute 610 so as to be rotatable.

The principal guide device 500 and the auxiliary guide device 600 guide the paper S, which is transported from the pair of paper transport rollers 54 (see FIG. 1), to the second transfer device 30. Specifically, the paper S is advanced from the lower side toward the upper side via the paper feed/transport path 56, which passes between the principal guide device 500 and the auxiliary guide device 600, to be fed between the second transfer roller 31 and the intermediate transfer belt 21.

As illustrated in FIG. 2, the paper feed/transport path 56 is curved between the principal guide device 500 and the auxiliary guide device 600. For further description, the paper feed/transport path 56 is curved in the direction (rightward in the drawing) away from the intermediate transfer belt 21 toward the downstream side in the transport direction of the paper S. The principal guide device 500 may be considered to vary the direction of the paper S which is transported from the pair of paper transport rollers 54 (see FIG. 1). In the illustrated example, the paper S, which is fed from between the principal guide device 500 and the auxiliary guide device 600 to the second transfer roller 31, is transported to the second transfer roller 31 in a curved state.

Therefore, the rear end of the paper S is restrained by the principal guide device 500 which is disposed on the outer side of the curve. That is, the paper S stores a force to bounce the rear end thereof toward the intermediate transfer belt 21 when the paper S finishes passing through the principal guide device 500. In the image forming apparatus 1 according to the present exemplary embodiment, the principal guide device 500 suppresses the bounce of the rear end of the paper S.

<Structure of Principal Guide Device 500>

Figure 3:
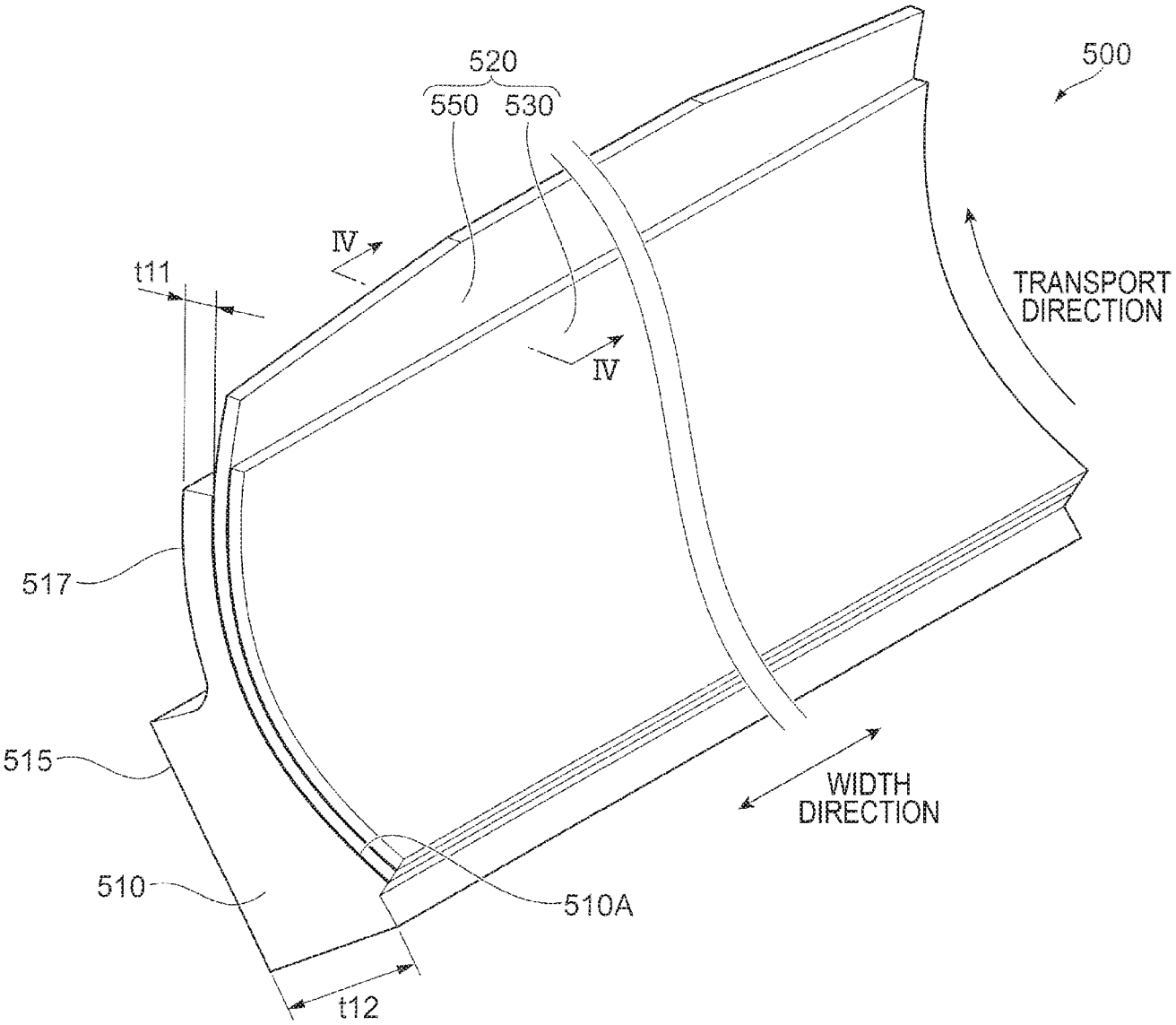
FIG. 3 is a perspective view of a principal guide device.

FIG. 3 is a perspective view of the principal guide device 500.

Figure 4:
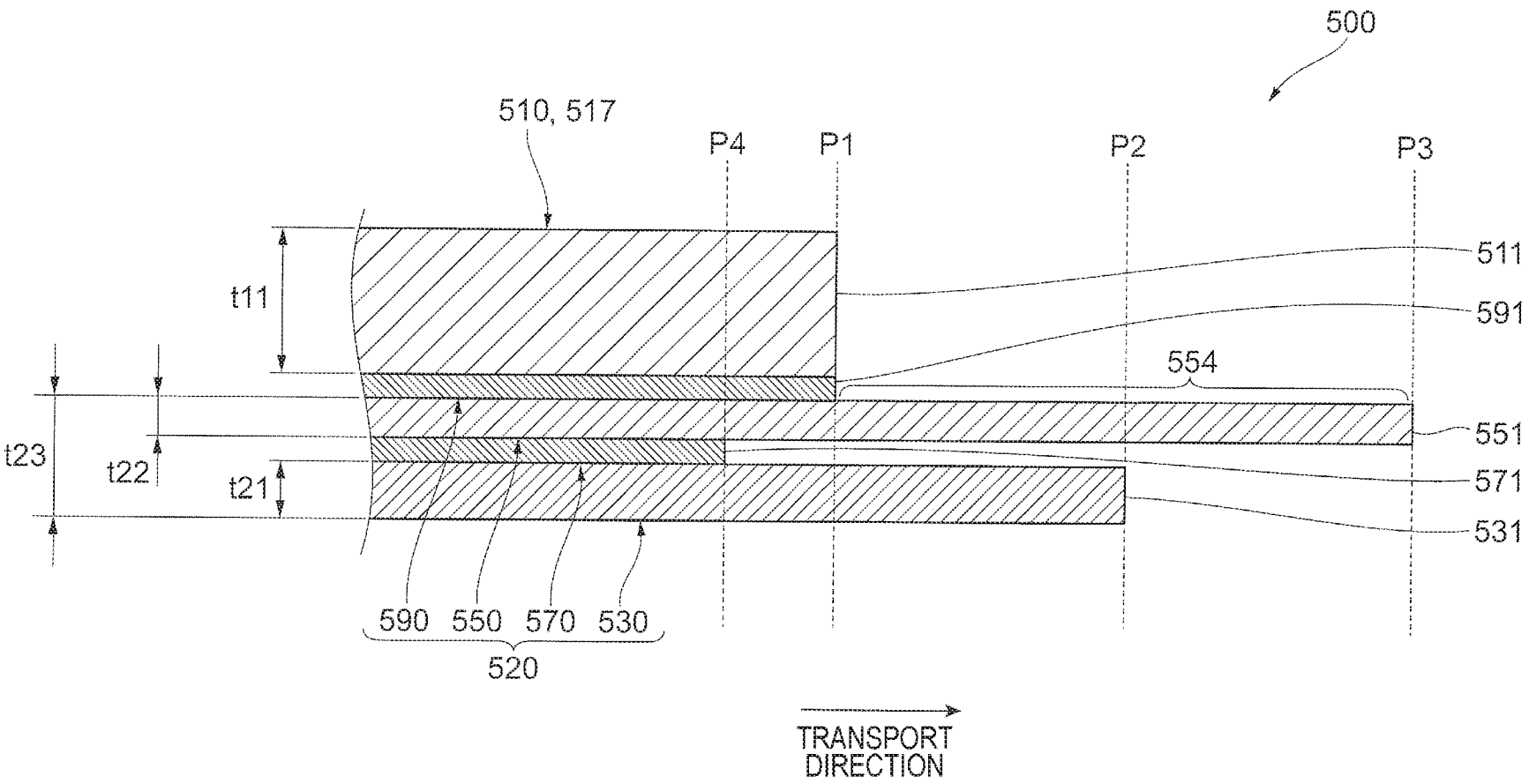
FIG. 4 is a sectional view of a guide device taken along the line IV-IV in FIG. 3.

FIG. 4 is a sectional view of the principal guide device 500 taken along the line IV-IV in FIG. 3.

Figure 5:
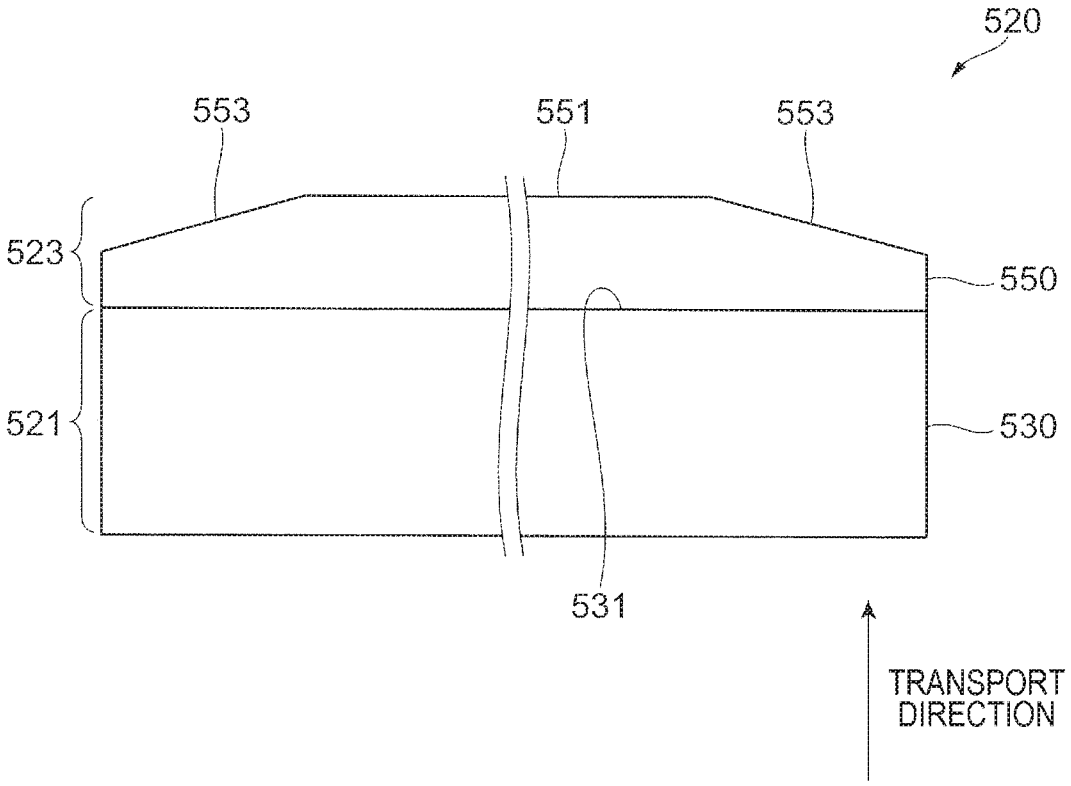
FIG. 5 is a plan view of a mylar.

FIG. 5 is a plan view of the mylar 520.

Next, the configuration of the principal guide device 500 will be described in detail with reference to FIGS. 2 to 5.

First, as described above, the principal guide device 500 includes the chute 510 and the mylar 520. The chute 510 and the mylar 520 are wider than the paper S in the width direction which intersects the transport direction of the paper S.

The chute 510 is a plate-like member formed from a resin etc. The chute 510 includes a chute body 515 in a substantially rectangular parallelepiped shape and a projecting portion 517 that projects from the downstream side, in the transport direction, of the chute body 515. In the illustrated example, the chute body 515 and the projecting portion 517 together form a curved surface 510A on the side opposite to the intermediate transfer belt 21. The chute 510 is thinner on the downstream side in the transport direction than on the upstream side in the transport direction. Specifically, a thickness t11 of the projecting portion 517 is smaller than a thickness t12 of the chute body 515.

The mylar 520 is a plate-like member that is elastically deformable as the paper S is transported along the mylar 520. For further description, the mylar 520 is more easily elastically deformable than the chute 510. The mylar 520 is provided on the curved surface 510A of the chute 510. For further description, the mylar 520 is provided as pasted in a curved state to a surface of the chute 510 on the side opposite to the intermediate transfer belt 21.

Since the mylar 520 illustrated in the drawing is pasted to a surface of the chute 510 on the side opposite to the intermediate transfer belt 21, the mylar 520 is disposed at a position away from the intermediate transfer belt 21 compared to a configuration in which the mylar 520 is pasted to a surface of the chute 510 on the side of the intermediate transfer belt 21. This suppresses contact of the mylar 520, which is pressed by the paper S to be warped, with the intermediate transfer belt 21 when the paper S passes through the mylar 520.

As illustrated in FIG. 4, the mylar 520 includes a first mylar 530, a second mylar 550, a first adhesive layer 570, and a second adhesive layer 590. In the illustrated example, the second adhesive layer 590, the second mylar 550, the first adhesive layer 570, and the first mylar 530 of the mylar 520 are provided as stacked on the chute 510 sequentially in this order. The mylar 520 illustrated in the drawing may be considered as being formed by superposing a plurality of mylars, namely the first mylar 530 and the second mylar 550. The mylar 520 may be considered as becoming thinner toward the downstream side in the paper transport direction.

As illustrated in FIG. 4, the first mylar 530 is a plate-like member constituted from an elastically deformable resin material (e.g. PET) etc. A thickness t21 of the first mylar 530 is smaller than the thickness t11 of the projecting portion 517. The first mylar 530 is longer in the transport direction than the chute 510. As illustrated in FIG. 5, the first mylar 530 has a substantially rectangular shape as viewed in plan. For further description, an end portion 531 of the first mylar 530 on the downstream side in the transport direction is a substantially straight portion that extends along the transport direction. As discussed in detail later, the first mylar 530 has a function of controlling the transport direction of a leading end SL of the paper S which is transported.

As illustrated in FIG. 4, the second mylar 550 is a plate-like member constituted from an elastically deformable resin material (e.g. PET) etc. In the illustrated example, the second mylar 550 is constituted from the same material as that of the first mylar 530. A thickness t22 of the second mylar 550 is smaller than the thickness t21 of the first mylar 530. For further description, the second mylar 550 is more easily elastically deformable than the first mylar 530. The second mylar 550 is longer in the transport direction than the chute 510 and the first mylar 530. For example, the thickness t22 of the second mylar 550 is 0.1 mm. A thickness t23 of a portion constituted from the first mylar 530, the first adhesive layer 570, and the second mylar 550 is 0.18 to 0.25 mm, for example. In this example, additionally, the thickness t23 of a portion constituted from the first mylar 530, the first adhesive layer 570, and the second mylar 550 is in the range of 1.8 times to 2.5 times of the thickness t22 of the second mylar 550.

As illustrated in FIG. 5, the second mylar 550 has a substantially rectangular shape as viewed in plan. For further description, an end portion 551 of the second mylar 550 on the downstream side in the transport direction has a trapezoidal shape in which the center portion in the transport direction projects toward the downstream side in the transport direction. The end portion 551 on the downstream side in the transport direction has inclined portions 553 inclined toward the downstream side in the transport direction as the inclined portions 553 extend toward the center side in the width direction. Since the second mylar 550 has the inclined portions 553, the posture of the rear end of the paper S is stabilized. That is, the rear end of the paper S may be in a flat posture with the inclined portions 553 of the second mylar 550 suppressing the rear end of the paper S which has passed through the second mylar 550 being in a bent posture (e.g. a V-shape or an inverted V-shape) as seen from the upstream side in the transport direction. As discussed in detail later, the second mylar 550 has a function of controlling the transport direction of the rear end of the paper S which is transported.

With reference to FIG. 4 again, the first adhesive layer 570 is a member that has adhesive properties such as a so-called double-sided tape or an adhesive. The first adhesive layer 570 bonds the first mylar 530 and the second mylar 550 to each other.

The second adhesive layer 590 is a member that has adhesive properties such as a so-called double-sided tape or an adhesive. The second adhesive layer 590 bonds the second mylar 550 and the chute 510 to each other.

As illustrated in FIG. 3, respective end portions, on the upstream side in the transport direction, of the first mylar 530, the second mylar 550, the first adhesive layer 570, and the second adhesive layer 590 are aligned with each other. On the other hand, respective end portions, on the downstream side in the transport direction, of the first mylar 530, the second mylar 550, the first adhesive layer 570, and the second adhesive layer 590 are not aligned with each other.

Specifically, as illustrated in FIG. 4, the end portion 531 of the first mylar 530 on the downstream side in the transport direction is disposed at a position P2 on the downstream side in the transport direction with respect to a position P1 of an end portion 511 of the projecting portion 517 on the downstream side in the transport direction. A position P3 of the end portion 551 of the second mylar 550 on the downstream side in the transport direction is positioned on the downstream side in the transport direction with respect to the position P2 of the end portion 531 of the first mylar 530. In other words, the end portion 531 of the first mylar 530 and the end portion 551 of the second mylar 550 are disposed at different positions from each other (see the position P2 and the position P3).

A position P4 of an end portion 571 of the first adhesive layer 570 on the downstream side in the transport direction is positioned on the upstream side in the transport direction with respect to the position P1 of the end portion 511 of the projecting portion 517 of the chute 510 on the downstream side in the transport direction. An end portion 591 of the second adhesive layer 590 on the downstream side in the transport direction is disposed at the position P1 together with the end portion 511 of the projecting portion 517 of the chute 510 on the downstream side in the transport direction. In other words, the end portion 571 of the first adhesive layer 570 and the end portion 591 of the second adhesive layer 590 are disposed at different positions from each other (see the position P1 and the position P4).

Since the end portion 571 of the first adhesive layer 570 is positioned on the upstream side in the transport direction with respect to the end portion 511 of the projecting portion 517, the possibility that the end portion 571 of the first adhesive layer 570 is on the downstream side in the transport direction with respect to the end portion 511 of the projecting portion 517 is suppressed even in the case where the position of the first adhesive layer 570 is fluctuated in the manufacturing stage. That is, a projecting region 554 of the second mylar 550 that projects toward the downstream side in the transport direction with respect to the projecting portion 517 is not likely to be bonded by the first adhesive layer 570.

In the illustrated example, the projecting region 554 of the second mylar 550 is not bonded to the first mylar 530, and therefore is elastically deformable independently of the first mylar 530. This enables the entire projecting region 554 of the second mylar 550 to be movable in the direction away from the first mylar 530. Additionally, the first adhesive layer 570 does not bond the end portion 531 of the first mylar 530 and the end portion 551 of the second mylar 550 to each other. This increases the movable ranges of the first mylar 530 and the second mylar 550.

<Operation of Principal Guide Device 500>

Figure 6B:
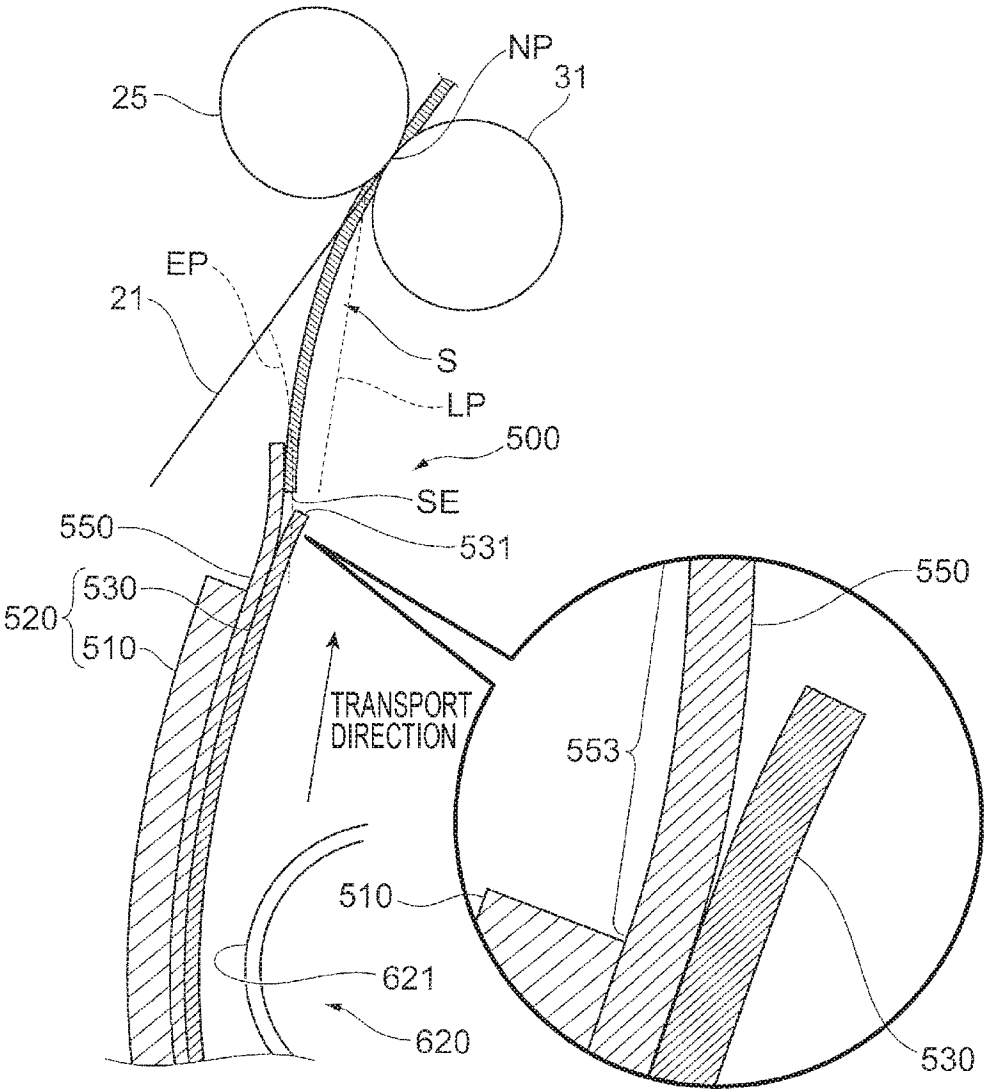
FIGS. 6A and 6B illustrate operation of the principal guide device.
Figure 6A:
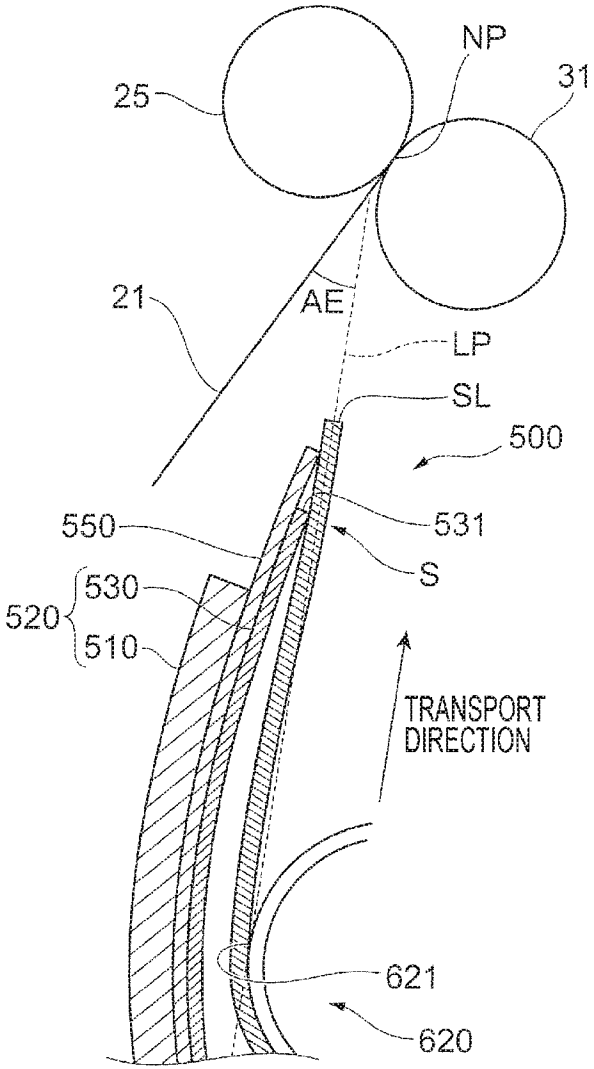

FIGS. 6A and 6B illustrate operation of the principal guide device 500. Specifically, FIG. 6A illustrates operation of the principal guide device 500 at the time when the leading end SL of the paper S passes, and FIG. 6B illustrates operation of the principal guide device 500 at the time when a rear end SE of the paper S passes.

Next, operation of the principal guide device 500 will be described with reference to FIGS. 1, 6A, and 6B.

First, operation of the principal guide device 500 at the time when the leading end SL of the paper S passes will be described with reference to FIGS. 1 and 6A. As illustrated in FIG. 6A, when the paper S which is transported from the pair of paper transport rollers 54 passes through the principal guide device 500, the mylar 520 is pressed by the paper S to be warped. At this time, the first mylar 530 and the second mylar 550 are pressed toward the intermediate transfer belt 21 compared to before the arrivals of the paper S. The paper S, which is guided by the first mylar 530 and the second mylar 550 in the pressed state, is moved toward the nip point NP at which the second transfer roller 31 and the intermediate transfer belt 21 contact each other. At this time, the paper S is supported by the first mylar 530 and the second mylar 550, and thus the angle at which the leading end SL of the paper L approaches the intermediate transfer belt 21, that is, an entry angle AE at which the leading end SL of the paper S enters the nip point NP, is smaller than that for a case where the paper S is not supported by the first mylar 530 and the second mylar 550. For further description, since the first mylar 530 which is more rigid supports the paper S, the position at which the leading end SL of the paper S contacts the intermediate transfer belt 21 is closer to the nip point NP.

Next, operation of the principal guide device 500 at the time when the rear end SE of the paper S passes will be described with reference to FIGS. 1 and 6B. First, as illustrated in FIG. 6B, when the paper S passes through the principal guide device 500, the mylar 520 is pressed by the paper S to be warped. When the rear end SE of the paper S passes through the end portion 531 of the first mylar 530 on the downstream side in the transport direction, the rear end SE of the paper S is supported by only the second mylar 550. At this time, the second mylar 550 is pressed to be bent toward the intermediate transfer belt 21 to a greater degree than in a state in which the rear end SE of the paper S is supported by both the first mylar 530 and the second mylar 550. Since the paper S is guided by the second mylar 550 which is pressed to be bent to a greater degree in this manner, the paper S may be transported with the rear end SE of the paper S brought closer to the intermediate transfer belt 21. Since the projecting region 554 of the second mylar 550 is deformable independently of the first mylar 530 as described above, the second mylar 550 may be warped more significantly toward the intermediate transfer belt 21.

When the rear end SE of the paper S finishes passing through the mylar 520, the rear end SE of the paper S is occasionally bounced with the paper S in a curved state released from the pressing force of the mylar 520. When the bounced rear end SE of the paper S hits the intermediate transfer belt 21 or generates a wind pressure toward the intermediate transfer belt 21, for example, the toner image formed on the intermediate transfer belt 21 may be scattered to lower the quality of the image. This phenomenon in which the rear end SE of the paper S is bounced is varied in accordance with the type (such as paper type, thickness, and basis weight, for example) of the paper S. For further description, the rear end SE of the paper S is bounced to lower the quality of the image to a greater degree in the case where the paper S is cardboard and is more rigid, for example.

In the present exemplary embodiment, however, the paper S is guided by the second mylar 550, and thus an impact caused when the rear end SE of the paper S contacts the intermediate transfer belt 21 is mitigated. In other words, the second mylar 550 allows soft landing of the rear end SE of the paper S on the intermediate transfer belt 21.

In the present exemplary embodiment, the mylar 520 includes both the first mylar 530 and the second mylar 550, and thus a path LP for the passage of the leading end SL of the paper S which is guided by the mylar 520 and a path EP for the passage of the rear end SE are different from each other. For further description, the path EP for the passage of the rear end SE is disposed closer to the intermediate transfer belt 21 than the path LP for the passage of the leading end SL. Additionally, in the illustrated example, the leading end SL and the rear end SE of the paper S are guided by the mylar 520 in different directions from each other.

In general, in order to regulate the entry angle AE of the leading end SL of the paper S, the mylar 520 is preferably thicker in order to enhance the function of guiding the paper S. In order to mitigate the impact of the rear end SE of the paper S, on the other hand, the mylar 520 is preferably thinner in order to promote soft landing. For further description, if the mylar 520 is made thicker in order to regulate the entry angle AE of the leading end SL, the mylar 520 is not easily warped, which increases the impact of the rear end SE.

Thus, in the present exemplary embodiment, the mylar 520 includes both the first mylar 530 and the second mylar 550, and thus the mylar 520 is provided with a thick portion (see a region 521 in FIG. 5) and a thin portion (see a region 523 in FIG. 5). This provides the thick portion of the mylar 520 with the function of regulating the entry angle AE, and provides the thin portion of the mylar 520 with the function of suppressing toner scattering. In other words, the thick portion of the mylar 520 supports the leading end side of the paper S relatively strongly, and the thin portion of the mylar 520 supports the rear end side of the paper S relatively weakly. In the present exemplary embodiment, the amount of warp of the mylar 520 may be stabilized even in the case where the type of the paper S is varied such as when the paper S is switched between thin paper and thick paper, for example.

<Modifications>

FIGS. 7A to 7E illustrate modifications.

Next, modifications of the exemplary embodiment described above will be described with reference to FIGS. 7A to 7E. In the following description, components that are the same as those according to the exemplary embodiment described above are occasionally denoted by the same reference numerals to omit description.

Figure 7A:
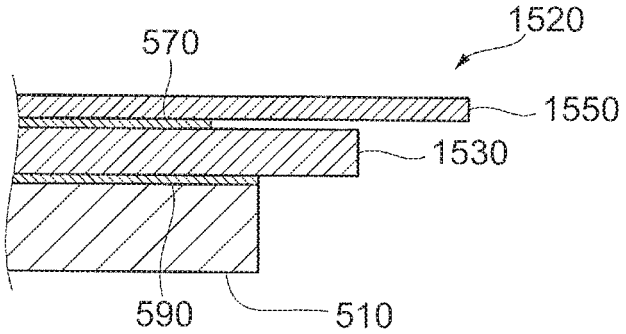
FIGS. 7A to 7E illustrate modifications.
Figure 7B:
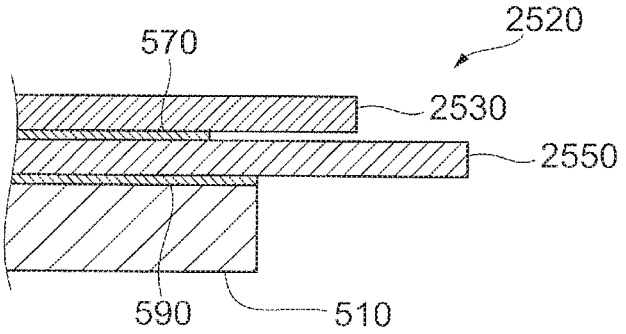

In the above description, the second adhesive layer 590, the second mylar 550, the first adhesive layer 570, and the first mylar 530 are provided as stacked on the chute 510 sequentially in this order. However, the present disclosure is not limited thereto. For example, as in a mylar 1520 illustrated in FIG. 7A, the second adhesive layer 590, a first mylar 1530, the first adhesive layer 570, and a second mylar 1550 may be stacked on the chute 510 sequentially in this order. The second mylar 1550 illustrated in FIG. 7A is warped while pressing the first mylar 1530 when supporting the rear end SE of the paper S. Thus, the second mylar 1550 is warped to a smaller degree than the second mylar 550 of the mylar 520 illustrated in FIG. 4.

In the above description, the second mylar 550 is thinner than the first mylar 530. However, the present disclosure is not limited thereto. For example, as in a mylar 2520 illustrated in FIG. 7B, a first mylar 2530 and a second mylar 2550 may be as thick as each other. Alternatively, unlike the illustrated example, the second mylar 2550 may be thicker than the first mylar 2530.

Figure 7C:
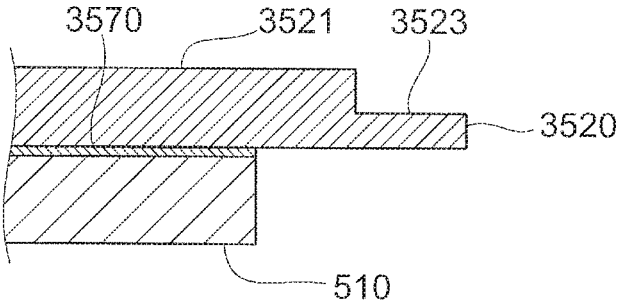

In the above description, the mylar 520 is formed by superposing the first mylar 530 and the second mylar 550 on each other. However, the present disclosure is not limited thereto. For example, as illustrated in FIG. 7C, a mylar 3520 may be formed from a single plate-like member. The mylar 3520 includes a thick region 3521 that is thick on the upstream side in the paper transport direction, and a thin region 3523 that is thinner than the thick region 3521 on the downstream side in the paper transport direction. The mylar 3520 is fixed to the chute 510 by an adhesive layer 3570.

Figure 7D:
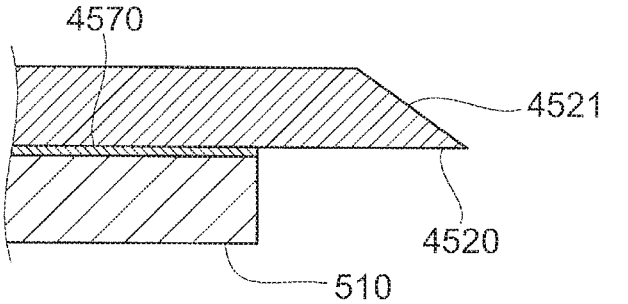

Further, as illustrated in FIG. 7D, for example, a mylar 4520 may be formed from a single plate-like member, and include an inclined surface 4521 that becomes thinner toward the downstream side in the paper transport direction. The mylar 4520 is fixed to the chute 510 by an adhesive layer 4570.

Figure 7E:
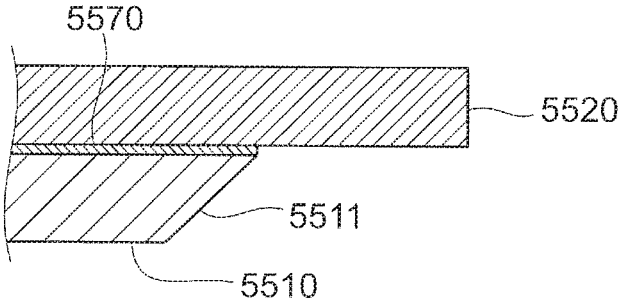

Meanwhile, as illustrated in FIG. 7E, for example, a mylar 5520 may be formed from a single plate-like member that is not varied in thickness along the paper transport direction, and a chute 5510 may include an inclined surface 5511 that becomes thinner toward the downstream side in the paper transport direction. The mylar 5520 is fixed to the chute 5510 by an adhesive layer 5570.

Although not illustrated, the mylar 520 may be constituted from three (i.e. three layers) or more plate-like members. The plurality of plate-like members of the mylar 520 may be constituted from different materials from each other.

In the above description, the principal guide device 500 guides the paper S to the second transfer device 30. However, the present disclosure is not limited thereto. For example, the principal guide device 500 may be used as a structure that guides the paper S to the fixing device 40 (FIG. 1). Specifically, the leading end SL of the paper S may be guided toward the heating rotary member 41 by the first mylar 530 and the second mylar 550 of the principal guide device 500. Meanwhile, the rear end SE of the paper S may be guided toward the pressurizing rotary member 42 by the second mylar 550.

Although not described in detail, the principal guide device 500 described above may be used as a structure that guides the paper S to a photosensitive drum in a configuration in which a toner image is formed on the photosensitive drum and the toner image is transferred from the photosensitive drum to the paper S in an image forming method that is different from that of the image forming apparatus 1 illustrated in FIG. 1.

The paper S in the above description is an example of the recording material. The second transfer device 30 is an example of the transfer section. The chute 510 is an example of the guide section. The mylar 520 is an example of the plate material. The first mylar 530 is an example of the first layer. The second mylar 550 is an example of the second layer. The region 521 is an example of the thick region. The region 523 is an example of the thin region. The inclined portion 553 is an example of the inclined portion. The intermediate transfer belt 21 is an example of the image holding member and the first rotator. The chute body 515 is an example of the body. The projecting portion 517 is an example of the projecting portion. The second transfer roller 31 is an example of the second rotator. The principal guide device 500 is an example of the recording material guide device.

While a variety of exemplary embodiments and modifications have been described above, it is a matter of course that such exemplary embodiments and modifications may be combined with each other.

In addition, the present disclosure is not limited to the exemplary embodiment described above in any way, and may be implemented in a variety of forms without departing from the scope and spirit of the present disclosure.

What is claimed is:

1. An image forming apparatus comprising:

a transfer section that transfers an image to a recording material;

a guide section that guides the recording material toward the transfer section; and a plate material that is provided on the guide section and that is more easily elastically deformable than the guide section, the plate material guiding the recording material, which is transported to the plate material, along a plate surface of the plate material, and being thinner on a downstream side in a transport direction than on an upstream side, wherein the plate material includes a first layer and a second layer, wherein an end portion of the first layer is disposed at a position in the transport direction upstream of an end portion of the second layer and the first layer is thicker than the second layer.

2. The image forming apparatus according to claim 1, wherein the first layer and the second layer are stacked on each other.

3. The image forming apparatus according to claim 2, wherein an adhesive layer is provided between the first layer and the second layer to bond the first layer and the second layer to each other, and the adhesive layer does not bond respective end portions, on the downstream side in the transport direction, of the first layer and the second layer to each other.

4. The image forming apparatus according to claim 1, wherein the plate material includes a thick region that is thick on the upstream side in the transport direction, and a thin region that is thin on the downstream side in the transport direction, an end portion of the thin region on the downstream side in the transport direction includes an inclined portion that extends more toward the downstream side in the transport direction at a location closer to a center in a width direction that intersects the transport direction, and an end portion of the thick region on the downstream side in the transport direction is formed to be straight along the width direction.

5. The image forming apparatus according to claim 4, wherein the end portion of the thin region on the downstream side in the transport direction is in a shape of a trapezoid that has the inclined portion provided on each side in the width direction as a leg of the trapezoid.

6. The image forming apparatus according to claim 1, wherein the transfer section includes an image holding member that holds the image to be transferred to the recording material on an outer peripheral surface of the image holding member, the guide section includes a body and a projecting portion that projects from the body toward the downstream side in the transport direction, and the plate material is provided on a surface of the projecting portion on a side opposite to the image holding member, and projects toward the downstream side in the transport direction with respect to the projecting portion.

7. The image forming apparatus according to claim 6, wherein the guide section is provided in a region in which a transport path for the recording material is curved, the surface of the projecting portion on the side opposite to the image holding member has a curved surface that extends along the curved transport path, and the plate material is pasted to the curved surface.

8. The image forming apparatus according to claim 7, wherein the image to be formed on the image holding member is larger in dimension than the recording material.

9. An image forming apparatus comprising:

a transfer section that transfers an image to a recording material;

a guide section that guides the recording material toward the transfer section; and a plate material that is provided on the guide section and that is more easily elastically deformable than the guide section, the plate material guiding the recording material, which is transported to the plate material, along a plate surface of the plate material, wherein the plate material includes a first layer and a second layer, and respective end portions of the first layer and the second layer on a downstream side in a transport direction of the recording material are at different positions from each other with the end portion of the first layer positioned in the transport direction upstream of the end portion of the second layer, and the first layer is thicker than the second layer.

10. The image forming apparatus of claim 9, wherein the first layer and the second layer are stacked on each other.

11. An image forming apparatus comprising:

a first rotator provided so as to be rotatable;

a second rotator provided at a position facing the first rotator so as to be rotatable, the second rotator transporting a recording material that passes through a facing region in which the second rotator faces the first rotator, a guide section that guides the recording material toward the facing region; and a plate material that is provided on the guide section and that is more easily elastically deformable than the guide section, the plate material guiding the recording material, which is transported to the plate material, along a plate surface of the plate material, and being thinner on a downstream side in a transport direction than on an upstream side, wherein the plate material includes a first layer and a second layer, wherein an end portion of the first layer is dispersed at a position in the transport direction upstream of an end portion of the second layer and the first layer is thicker than the second layer.

12. The image forming apparatus of claim 11, wherein the first layer and the second layer are stacked on each other.

13. A recording material guide device comprising:

a guide section that guides a recording material toward a facing region in which a first rotator and a second rotator face each other, the first rotator being provided so as to be rotatable and the second rotator being provided at a position facing the first rotator so as to be rotatable; and a plate material that is provided on the guide section and that is more easily elastically deformable than the guide section, the plate material guiding the recording material, which is transported to the plate material, along a plate surface of the plate material, and being thinner on a downstream side in a transport direction than on an upstream side, wherein the plate material includes a first layer and a second layer, wherein an end portion of the first layer is disposed at a position in the transport direction upstream of an end portion of the second layer and the first layer is thicker than the second layer.

14. The recording material guide device of claim 13, wherein the first layer and the second layer are stacked on each other.

* * * * *